US010665378B1

(12) United States Patent
Tu et al.

(10) Patent No.: US 10,665,378 B1
(45) Date of Patent: May 26, 2020

(54) SYSTEMS AND METHODS FOR AN INDUCTOR STRUCTURE WITH ENHANCED AREA USAGE OF A CIRCUIT

(71) Applicant: Marvell International Ltd., Hamilton (BM)

(72) Inventors: Cao-Thong Tu, Preverenges (CH); Konstantinos Manetakis, Lausanne (CH); Xiang Gao, Fremont, CA (US)

(73) Assignee: Marvell International Ltd., Hamilton (BM)

( * ) Notice: Subject to any disclaimer, the term of this patent is extended or adjusted under 35 U.S.C. 154(b) by 276 days.

(21) Appl. No.: 15/453,600

(22) Filed: Mar. 8, 2017

Related U.S. Application Data

(60) Provisional application No. 62/305,009, filed on Mar. 8, 2016.

(51) Int. Cl.

| | |
|---|---|
| ***H01F 17/00*** | (2006.01) |
| ***H01F 27/28*** | (2006.01) |
| ***H01F 27/40*** | (2006.01) |
| ***H01F 41/04*** | (2006.01) |

(52) U.S. Cl.
CPC ..... *H01F 27/2804* (2013.01); *H01F 27/2885* (2013.01); *H01F 27/40* (2013.01); *H01F 41/041* (2013.01)

(58) Field of Classification Search
CPC ..... H01F 27/2804; H01F 27/2885; H01F 2017/0073; H01F 41/041
USPC ..... 336/105, 200
See application file for complete search history.

(56) References Cited

U.S. PATENT DOCUMENTS

| | | | | |
|---|---|---|---|---|
| 5,039,964 | A * | 8/1991 | Ikeda | H03H 1/0007 333/181 |
| 6,060,882 | A * | 5/2000 | Doty | G01R 33/34046 324/318 |
| 6,479,997 | B1 * | 11/2002 | Westphal | G01R 33/3852 324/318 |
| 7,372,275 | B2 * | 5/2008 | Feenan | G01R 33/385 324/318 |
| 7,446,632 | B2 * | 11/2008 | Tomonari | H01F 17/0013 333/185 |
| 7,576,541 | B2 * | 8/2009 | Nabetani | G01R 33/341 324/318 |
| 8,198,893 | B2 * | 6/2012 | Fath | G01R 33/481 324/307 |

(Continued)

*Primary Examiner* — Alexander Talpalatski
*Assistant Examiner* — Joselito Baisa

(57) ABSTRACT

Embodiments described herein provide circuitry employing an inductor having enhanced circuit area usage. The circuitry includes an inductor having a first loop and a second loop adjoining the first loop to form a figure-eight configuration. The circuitry further includes a circuit component disposed at least partially inside an area defined by at least one of the first loop and the second loop. The inductor has an intersection portion between the first loop and the second loop. An input node is located proximate to the intersection portion, the input node having a first extension disposed inside the first loop. An output node is located proximate to the intersection portion. The output node has a second extension disposed inside the second loop. At least a first capacitor is coupled to the input node and the second extension, and at least a second capacitor coupled to the output node and the first extension.

11 Claims, 6 Drawing Sheets

(56) References Cited

U.S. PATENT DOCUMENTS

| | | | | |
|---|---|---|---|---|
| 8,319,593 | B2 * | 11/2012 | Ke | H01F 27/2804 336/145 |
| 8,559,186 | B2 * | 10/2013 | Jin | H01F 17/0006 361/794 |
| 8,841,983 | B2 * | 9/2014 | Newton | H01F 17/0006 336/200 |
| 9,019,065 | B2 * | 4/2015 | Gianesello | H01F 17/0006 336/200 |
| 9,519,075 | B2 * | 12/2016 | Jachmann | E21B 47/00 |
| 2004/0155728 | A1 * | 8/2004 | Cheung | H01P 3/003 333/161 |
| 2005/0140486 | A1 * | 6/2005 | Lin | H01F 17/0013 336/200 |
| 2009/0315662 | A1 * | 12/2009 | Hijioka | H01F 17/0013 336/200 |
| 2012/0092206 | A1 * | 4/2012 | Etebari | G01V 3/12 342/22 |
| 2012/0112979 | A1 * | 5/2012 | Kato | H01P 1/20 343/853 |
| 2016/0013661 | A1 * | 1/2016 | Kurs | B60L 53/36 307/104 |

* cited by examiner

SYSTEMS AND METHODS FOR AN INDUCTOR STRUCTURE WITH ENHANCED AREA USAGE OF A CIRCUIT

CROSS-REFERENCE TO RELATED APPLICATION

This claims the benefit under 35 U.S.C. § 119(e) of U.S. Provisional Patent Application No. 62/305,009, filed Mar. 8, 2016, which is hereby incorporated by reference herein in its entirety.

FIELD OF USE

This disclosure relates to a radio frequency inductor structure, and specifically, an inductor structure with enhanced area usage of a circuit.

BACKGROUND OF THE DISCLOSURE

The background description provided herein is for the purpose of generally presenting the context of the disclosure. Work of the inventors hereof, to the extent the work is described in this background section, as well as aspects of the description that is not otherwise qualify as prior art at the time of filing, are neither expressly nor impliedly admitted to be prior art against the present disclosure.

An inductor, which usually takes a form of a coil, is an electrical component that has two terminals and stores electric energy in a magnetic field when an electric current is flowing through it. A radiofrequency (RF) inductor, i.e., an inductor that is built to be operated with an alternating current at a radio frequency, is an important element for radiofrequency oscillators, amplifiers, filters, or the like. At radio frequencies, the inductors have higher resistance and power loss to the circuit, which reduce the Q factor of the circuit.

To maintain a desirable performance of the circuit, RF inductors typically are designed with a larger area, which usually consumes a significant area of the circuit. A metal-only area is usually used to host an inductor on the active area of a circuit, which leads to low area efficiency. Therefore, the current RF circuits suffer from a trade-off between performance and the size of the circuit; i.e., performance of the RF circuit usually needs to be sacrificed in order to achieve a small circuit size, or vice versa.

SUMMARY

Embodiments described herein provide circuitry employing an inductor having enhanced circuit area usage. The circuitry includes an inductor having a first loop and a second loop adjoining the first loop to form a figure-eight configuration. The circuitry further includes a circuit component disposed at least partially inside an area defined by at least one of the first loop and the second loop. The inductor has an intersection portion between the first loop and the second loop. An input node is located proximate to the intersection portion, the input node having a first extension disposed inside the first loop. An output node is located proximate to the intersection portion. The output node has a second extension disposed inside the second loop. At least a first capacitor is coupled to the input node and the second extension, and at least a second capacitor coupled to the output node and the first extension.

In some implementations, the first extension extends within a first planar surface defined by the first loop and from the input node, and the second extension extends within a second surface defined by the second loop and from the output node. The at least one first capacitor includes a plurality of capacitors, each coupled to the input node and the second extension in parallel to form a capacitor array, and the capacitor array operates to electromagnetically shield at least a part of the intersection portion.

In some implementations, the first loop or the second loop has one or more turns of electromagnetic coils, and wherein one or both of the at least one first capacitor and the at least one second capacitor span across multiple electromagnetic coils at the intersection.

In some implementations, the first extension extends perpendicularly to a first planar surface defined by the first loop and from the input node, and the second extension extends perpendicularly to a first planar surface defined by the first loop and from the output node. A part of the intersection portion forms a bridge that spans over the at least one first capacitor or the at least second capacitor.

In some implementations, an inductor shield formed in a figure-eight layout corresponding to the first and second loops and configured to cover the inductor, the area within the first loop or the second loop being uncovered.

In some implementations, the inductor shield includes a middle section covering the intersection, the middle section allowing a placement of the circuit component below the intersection when the circuit component is configured to connect to the input node or the output node. The inductor shield further includes a peripheral section covering turns of the first loop or the second loop, the peripheral section allowing routing signals to or from circuit elements placed below the inductor.

In some implementations, the middle section is composed of the at least one first capacitor and the at least one second capacitor.

In some implementations, the middle section has a structural pattern that is composed of a plurality of cross-connected quadruple squares.

In some implementations, the peripheral section is composed of a symmetrical structure. The symmetrical structure includes a first part having a plurality of floating lines connecting to the middle section, and a second part having a plurality of interrupted floating lines configured to allow current collection by one or more lines.

In some implementations, the circuit component is any of an integrated radio frequency oscillator, an amplifier, a filter or a phase-locked loop.

Embodiments described herein include a method for enhancing circuit area usage in an inductor. An inductor is formed to have a first loop and a second loop adjoining the first loop to form a figure-eight configuration on a circuit. The first loop and the second loop have an intersection portion. A first extension is formed to be extended from an input node located proximate to the intersection portion. The first extension is disposed inside the first inductor loop. A second extension is formed to be extended from an output node located proximate to the intersection portion. The second extension is disposed inside the second loop. A side of at least one first capacitor is connected to the input node, and another side of the at least one first capacitor is connected to the second extension. A side of at least one second capacitor is connected to the output node, and another side of the at least one second capacitor is connected to the first extension. A circuit component is formed at least partially inside an area defined by at least one of the first loop and the second loop.

BRIEF DESCRIPTION OF THE DRAWINGS

Further features of the disclosure, its nature and various advantages will become apparent upon consideration of the following detailed description, taken in conjunction with the accompanying drawings, in which like reference characters refer to like parts throughout, and in which.

DETAILED DESCRIPTION

Figure 3:
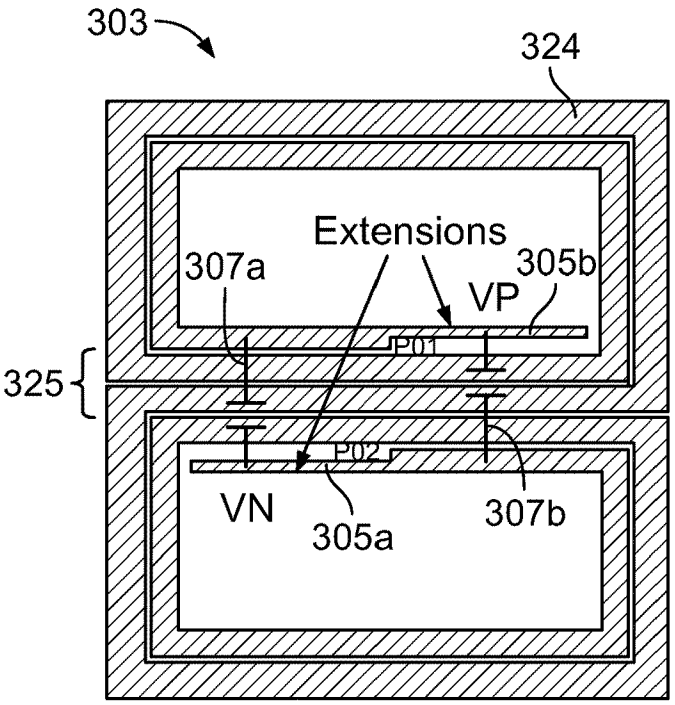
FIGS. 1-3 are block diagrams illustrating example RF inductor structures that allow efficient area usage of a circuit, according to some embodiments described herein.

This disclosure describes methods and systems for providing an inductor structure that allows enhanced area usage on a circuit. The term "circuit" is used throughout this disclosure to include, but is not limited to, an integrated circuit built on a semiconductor material such as silicon, a circuit built on a printed circuit board (PCB), and/or the like. The term "disposing" or "disposed" is used throughout this disclosure to indicate, but is not limited to, placing, fixing, arranging in a particular position, and/or the like. The term "configuring" or "configured" is used throughout this disclosure to indicate, but is not limited to putting one or more items together in a particular form or configuration, arranging or ordering one or more items at a particular location so as to fit the one or more items for a designated task, and/or the like. The term "forming" or "formed" is used throughout this disclosure to indicate, but is not limited to making an item into a certain shape of form, building, manufacturing, fabricating, assembling, and/or the like.

An inductor structure, such as a RF inductor structure, is used, in various embodiments, for integrated RF oscillators, amplifiers, filters, or the like.

Existing inductor structure, e.g., used in RF oscillators, usually has an inductor coil and any other elements connected to the inductor coil, e.g., the capacitor area, spatially separated to keep the other elements away from electromagnetic fields generated by the inductor coil. An example of the inductor coil includes a two-turn spiral inductor coil, placed within an active area of a circuit.

Inductor structure typically occupies a not-insubstantial area on a circuit. One reason is that the electromagnetic field surrounding an inductor requires that the area within coiled inductor 103 remain empty of other active components. To avoid or reduce electromagnetic impact, such components—e.g., capacitors—are disposed outside the active area where the inductor coil is disposed. Thus, the structure results in inefficient usage of the active area, e.g., the area 106 is often vacant and wasted. Moreover, the above factors typically affect the ability to place components in adjacent areas or within the projected area of the active area in adjacent layers.

Performance of the inductor structure is directly proportional to the size of the active area where the inductor coil is disposed, in some embodiments. However, as the size of the active area increases, a larger area typically is left unused, e.g., the empty active area within a loop of the inductor coil. For example, a symmetrical, step-and-repeat, and figure-eight-shaped inductor coil, which has two loops, results in more unused active area. Such figure-eight-shaped inductor coil is usually used in a system-on-the-chip (SOC) environment because, in comparison to a simple loop, the figure-eight shape typically exhibits enhanced resistance to parasitic coupling. In addition, when a separate capacitor area is required from the area where the inductor coil is disposed to avoid interference by the electromagnetic field of the inductor coil, the inductor structure typically occupies a significant area of the circuit in order to maintain the performance of the inductor.

Embodiments described herein provide an inductor structure that allows electrical components to be disposed within the empty active area within the loop of an inductor coil to enhance area usage. Specifically, the inductor structure has extensions from the input node or the output node of the inductor such that the extensions are configured to be used as the extended input or output nodes to connect to electrical components such as capacitors. In an embodiment, the extensions are disposed within a loop formed by the inductor coil, and the capacitors disposed in parallel and are connected to the extensions of the input and output nodes. Such capacitors form a capacitor array that shield at least a part of the inductor coil. Thus, electromagnetic effects of the inductor within the empty area inside the inductor loop is reduced because of the shielding provided by the capacitor array. In this way, when electrical components are disposed at the empty area inside the inductor loop, they remain shielded from electromagnetic effects of the inductor loop thereby facilitating enhanced area usage of the inductor circuit.

Figure 2:
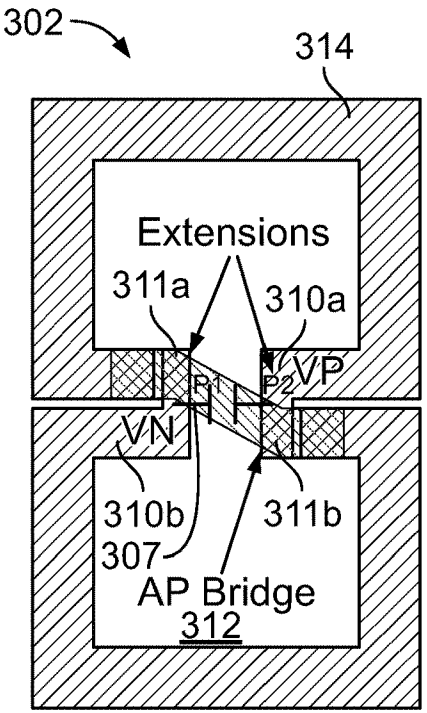
Figure 1:
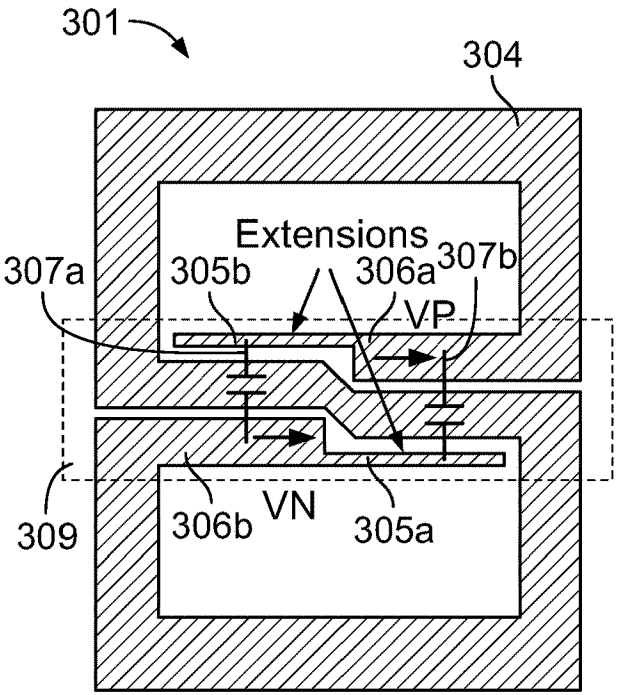

FIGS. 1-3 are block diagrams illustrating example RF inductor structures that allow efficient area usage of a circuit, according to some embodiments described herein. To enhance area-usage of an inductor, inductors 301, 302 and 303 provide an inductor topology having a common-centroid layout for figure-eight-shaped inductor coils.

In one implementation, as shown in FIG. 1, the inductor 301 has a figure-eight-shaped inductor coil 304, e.g., a first loop and a second loop adjoining the first loop. To form a figure-eight shape, the first loop and the second loop substantially overlaps with, intersects with or at least borders each other at an intersection portion in the middle of the figure-eight-shaped layout. The intersection portion 309 includes a segment of the first loop and a segment of the second loop, and the two segments are substantially parallel to each other. An input node 306*a* and an output node 306*b* are configured to be disposed in proximate to the intersection section 309. The input node 306*a*, configured to receive an input voltage $V_P$, includes in an embodiment an extension 305*b*, e.g., a metal line in the form of an extended finger from the input node 306*a*. The extension 305*b* extends from the input node 306*a* within a planar surface defined by the first loop of the figure-eight-shaped inductor coil 304, in an embodiment. As seen in FIG. 1, the extension 305*b* is disposed inside a central area defined by a loop of inductor coil 304 and substantially parallel to the intersection portion 309.

Similarly, in an embodiment, the output node 306*b*, providing an output voltage $V_N$, includes in an embodiment an extension 305*a*, e.g., a metal line in the form of an extended finger from the output node 306*b*. The extension 305*a* also extends from the output node 306*b* within a planar surface defined by the second loop of the figure-eight-shaped inductor coil 304 in an embodiment. As seen in FIG. 1, the extension 305*a* is disposed inside a central area defined by a loop of inductor coil 304 and is also substantially parallel to the intersection portion 309.

In an embodiment, extensions 305*a-b* are configured to couple capacitors at a position overlaying the intersection portion 309, in a different circuit layer of a multi-layered integrated circuit adjacent to (e.g., either below or above) the circuit layer in which the inductor coil 304 is disposed within the integrated circuit. This example arrangement obviates a need in conventional inductors to place capacitors in an area that is spatially separated but in the same plane as the inductor coil 304. For example, in an embodiment, a capacitor array 307*a* (only one capacitor is shown at 307*a* for illustrative purpose only), includes one or more capacitors connected in parallel, each coupling the extension 305*b* of the input node 306*a* and the output node 306*b*. Similarly, in the embodiment, another capacitor array 307*b* (only one capacitor is shown at 307*b* for illustrative purpose only) includes one or more capacitors connected in parallel, each coupling the extension 305*a* of the output node 306*b* and the input node 306*a*.

Thus in an embodiment, the capacitor arrays 307*a-b* form a comb-like structure that is disposed in an adjacent layer to the inductor coil 304 and covers at least a part of the intersection portion 309 of the figure-eight-shaped inductor coil 304. The comb-like structure of parallel capacitors serves as a shielding structure that shields the intersection portion 309 of the inductor coil 304. Because of the shielding configuration that shields against electromagnetic interference of at least the intersection portion 309, electrical components are placed, in one embodiment within and/or adjacent to (e.g. in a different layer) the empty area within the figure-eight layout, with reduced electromagnetic effects from the inductor coil. To further reduce electromagnetic effects from the inductor coil and to improve overall performance, additional shielding structures are applied to the inductor in an embodiment. Example embodiments of the additional shielding are further illustrated in FIGS. 4-8.

As shown in FIG. 2, the inductor 302 has a figure-eight-shaped inductor coil 314, similar to that of the inductor 301. In the embodiment of FIG. 2, the input node 310*a* has an extension 311*b* that extends perpendicularly to the planar surface defined by the figure-eight inductor coil 314. For example, the extension 311*b* is configured to extend into another layer of the circuit through a via on the layer in which the inductor coil 314 is disposed. Similarly, the output node 310*b* has an extension 311*a* extending in the same direction as the extension 311*b*. A capacitor array 307, including a plurality of parallel capacitors (only one capacitor is seen for the purposes of illustrative simplicity), couples the two extensions 311*a* and 311*b*. The input node 310*a* and the output node 310*b* are thus connected through the capacitor array 307 via the extensions 311*a-b*. The intersection portion of the figure-eight-shaped inductor coil includes a metal part that forms a bridge 307 that spans, in a different circuit layer from inductor coil 312, over or under the capacitor array 307. It is noted that in the embodiment of FIG. 2, the extensions 310*a-b* have reduced metal lines as compared to the extensions 305*a-b*, as the extensions 310*a-b* do not need to extend at a similar length as the extensions 305*a-b* in order to be proximate to the input node or the output node.

As shown in FIG. 3, the inductor 303 has a similar form to the form of inductor 301 (FIG. 4), e.g., with a figure-eight-shaped inductor coil 324 and extensions 305*a-b* co-located on the same planar surface with the inductor coil 324. Each loop of the figure-eight-shaped inductor coil 324 has multiple turns or loops, in an embodiment. As a result, the capacitor array(s) 307*a-b* spans across the widths of one or more inductor coils at the intersection portion 325. Thus, the capacitor array(s) 307*a-b* seen in FIG. 3 typically require longer metal lines for crossing intersection portion 325 as compared to the capacitor array 307 used in inductor 301.

By configuring the inductors 301-303 to formed with extensions from input and output nodes that are disposed inside the empty area of a loop of the conductor coil, a plurality of circuit elements such as capacitors are rendered connectable to the inductor coil at the input and output node of the conductors without necessitating that the capacitors take up area on the circuit in the same plane of the inductor but outside the inductor. In some implementations, circuit components, such as capacitors, or other electrical components are disposed at the empty area within the loops of the inductor coil 304 and are still connected to the inductor via the input and output nodes disposed proximate to the intersection portion. In this manner, the size of the circuit is reduced.

It is noted, the inductors 301-303 yield relatively low sensitivity to parasitic inductor loops due to the figure-eight layout style, and also low sensitivity to surrounding metals, which allows the inductor circuit to have a relatively small clearance area. Thus, inductors that are configured with the extensions achieve more efficient utilization of the active area on the circuit. Alternatively, since no planar area of an integrated circuit in excess of the area required for the inductor coil itself is needed for placement of electrical components such as capacitors, in accordance with an embodiment the inductor coil itself is enlarged within a circuit of the same form factor as a conventional circuit to thereby yield improved performance of the inductor.

Figure 4:
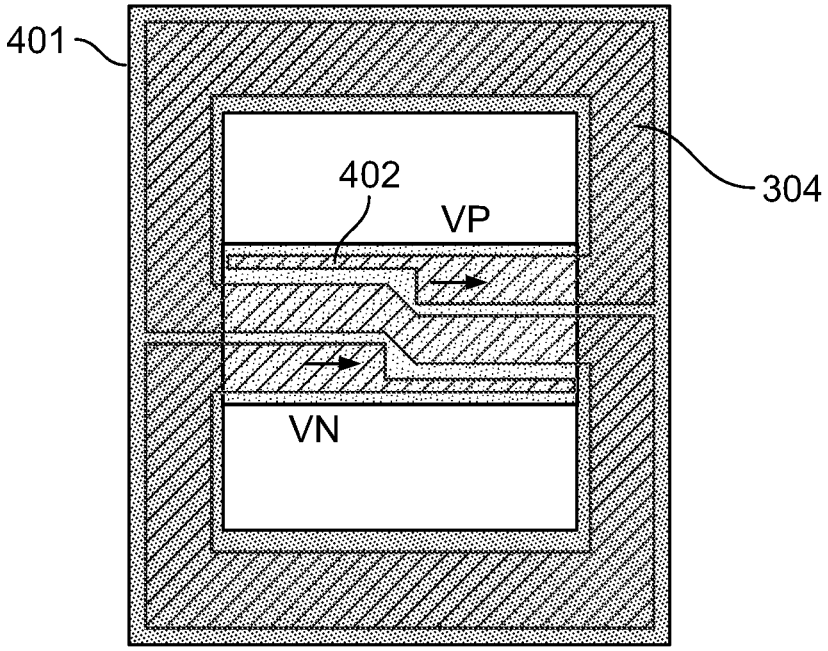
FIG. 4 is a block diagram illustrating aspects of an example shielding structure for the RF inductor structures shown in FIG. 1, according to some embodiments described herein.
Figure 5:
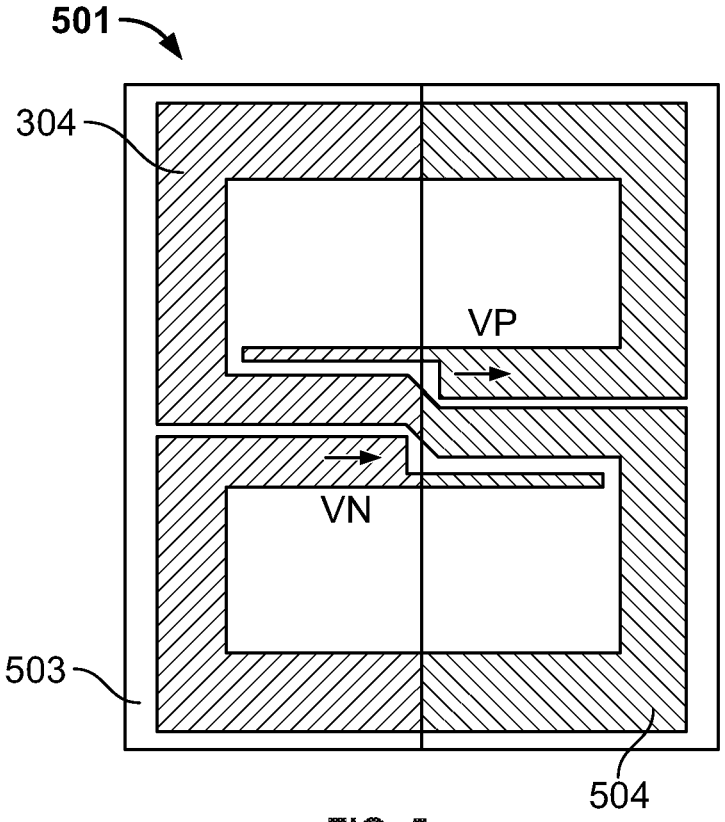
FIG. 5 is a schematic illustration of a symmetric shielding structure 501 for the peripheral section 401 as described in FIG. 4, according to some embodiments described herein.
Figure 6:
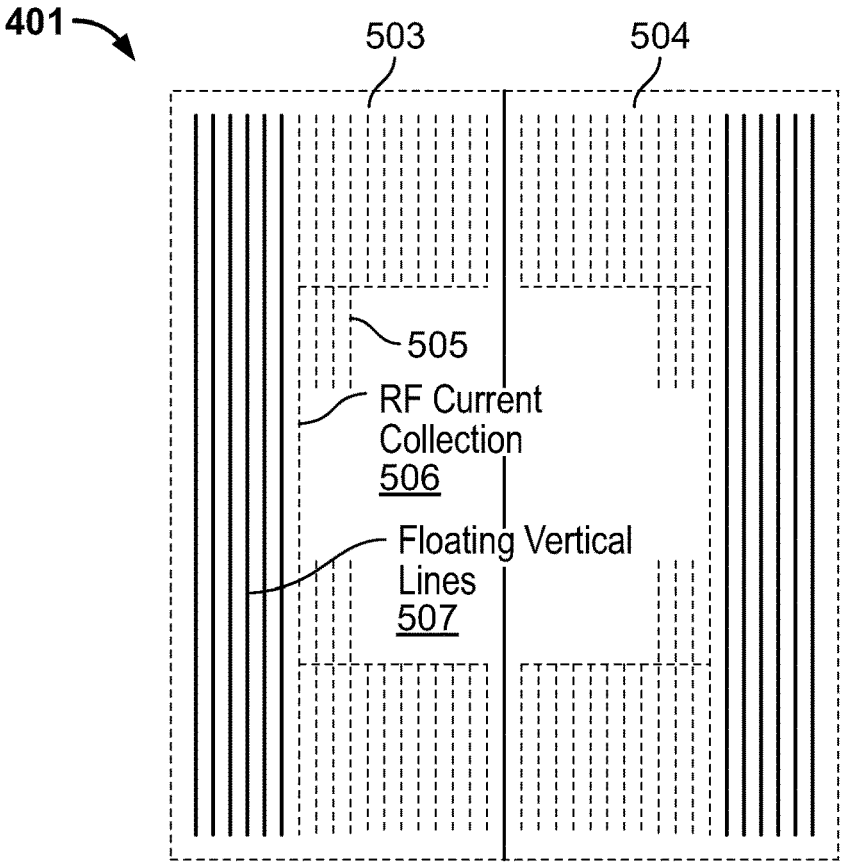
FIG. 6 is a block diagram illustrating aspects of a metal line composition of the symmetric shielding structure for the peripheral section, according to some embodiments described herein.

FIG. 4 is a block diagram illustrating aspects of an example shielding structure for the RF inductor structures shown in FIGS. 1-3, according to some embodiments described herein. The shield includes a structure placed at a circuit layer adjacent to the layer in which the inductor is disposed. The shield is configured to collect displacement electrical currents and redirect those currents to an opposite phase through a low impedance path such that the currents do not reach the silicon substrate. The shield structure is kept floating (e.g., not connected to the ground or other element from which the electrical properties of the shield can be determined) and slotted (e.g., without any circuit loop), as shown in one embodiment by the vertical floating lines 505 or 507 that compose at least part of the shielding structure in FIG. 6) to avoid magnetic loops that might give rise to lossy and eddy currents.

In an embodiment, the shield includes a middle section 402 that shields the intersection portion of the figure-eight inductor coil 304 and a peripheral section 401 that shields the main inductor turn(s) of the inductor coil 304. The middle section 402 allows active components (e.g., oscillators, transistors, integrated circuits, etc.) or passive components (e.g., resistances, capacitors, inductors, etc.) to be disposed below the intersection portion of the inductor 304 (with the shield in between), if such components need connections to the P/N sides, e.g., the input or output nodes of the inductor. The peripheral section 401 is placed between the main inductor turn and a silicone substrate, and thus protects the main inductor turns from substrate loss. The peripheral section 410 also potentially allows the shield to route charges from elements that are disposed on the other side of the shield from the inductor. In this way, the configuration of the shielding structure leaves an empty area within the loops of the inductor coil unshielded, and other electrical elements are disposed within the unshielded empty area for efficient area usage, e.g., see FIG. 9.

Figure 7:
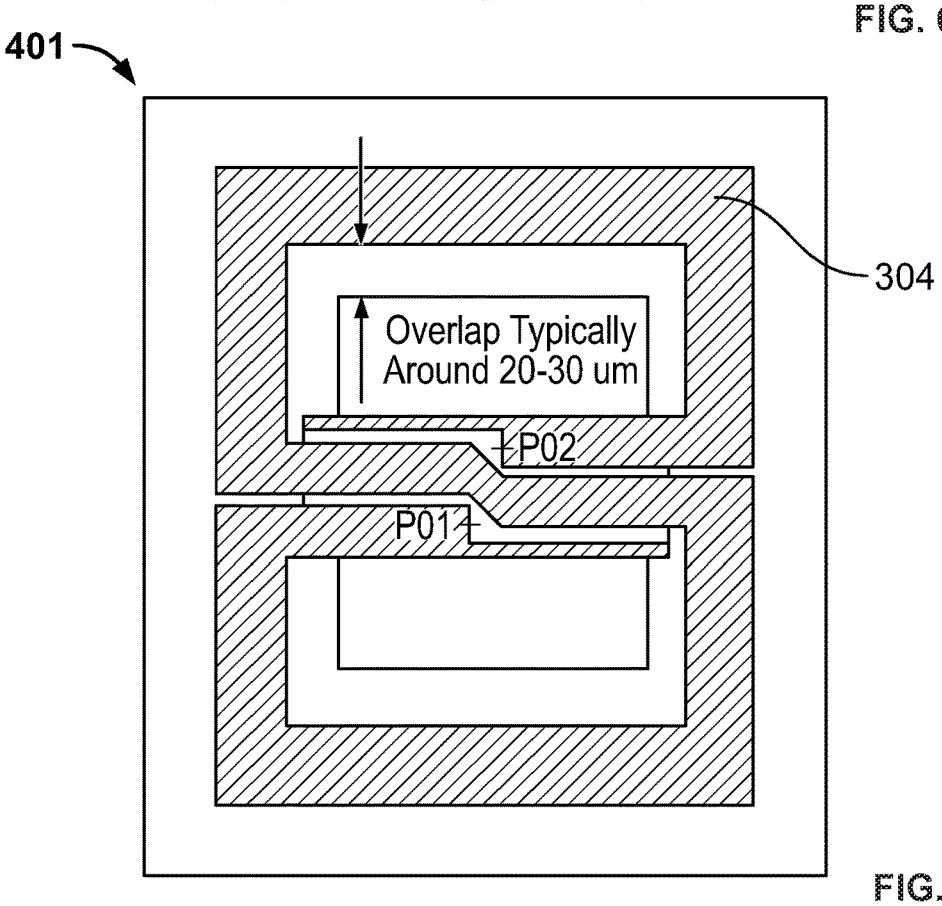
FIG. 7 is a block diagram illustrating an example size of the peripheral section 401 as described in FIG. 7, according to some embodiments described herein.
Figure 8:
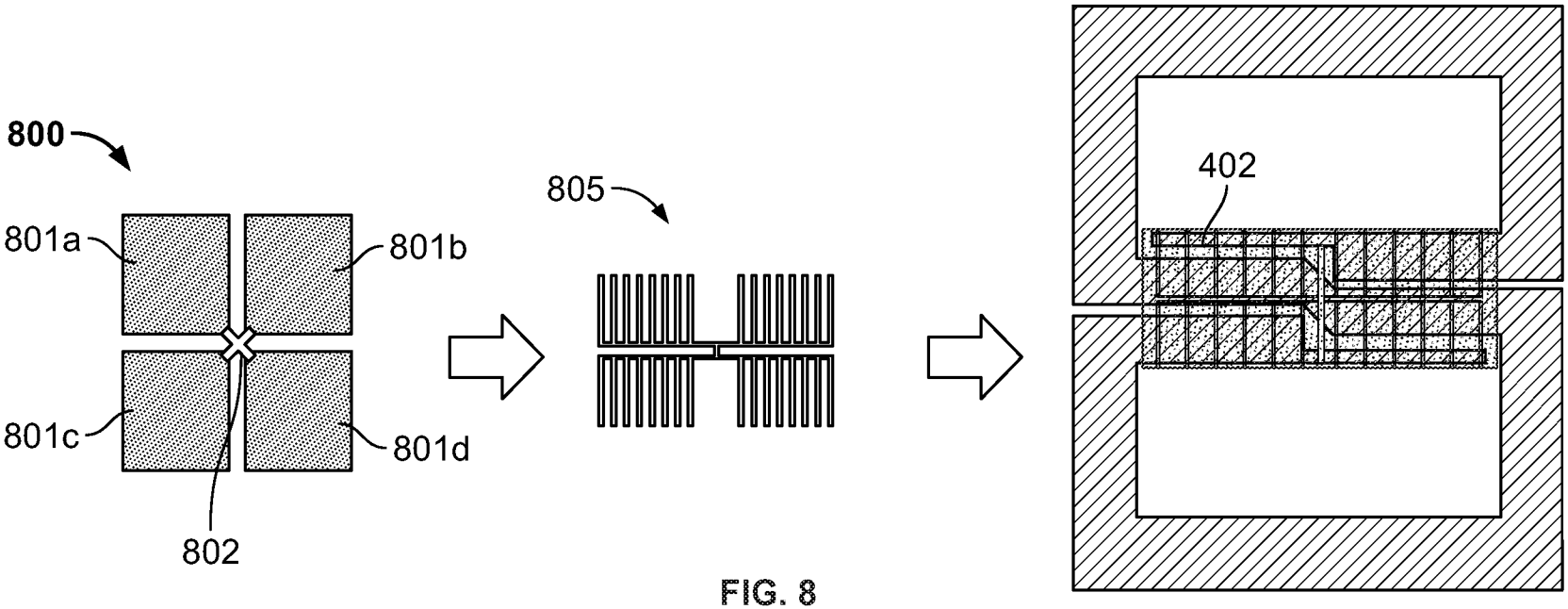
FIG. 8 is a block diagram illustrating an example shielding structure for the middle section of the shielding structure, according to some embodiments described herein.

FIG. 8 is a block diagram illustrating aspects of a symmetric shielding structure 501 for the peripheral section 401 as described in FIG. 7, according to some embodiments described herein. For example, in an embodiment, the shielding structure 501 is composed of two symmetric parts 503 and 504 that protect electrical components such as oscillators, filters, or the like on the circuit against electromagnetic effects from the inductor coil 304.

Figure 9:
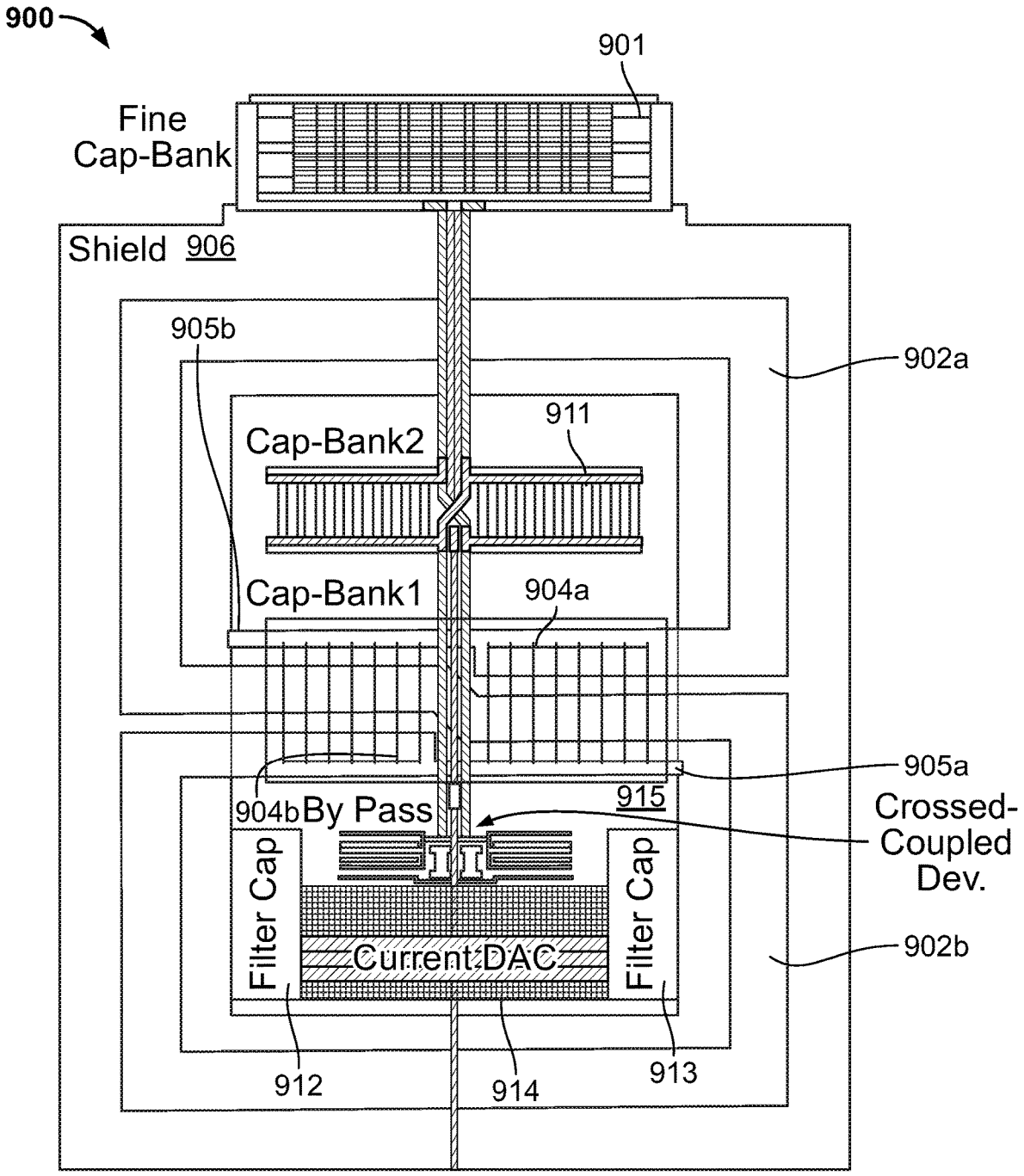
FIG. 9 is a block diagram illustrating example circuitry employing an inductor similar to inductor circuit 301 in FIG. 4, according to some embodiments described herein.

FIG. 9 is a block diagram illustrating aspects of a metal line composition of the symmetric shielding structure 503-504 in FIG. 8, according to some embodiments described herein. A symmetric half 503 of the peripheral section (e.g., 401 in FIG. 4) includes a plurality of vertical floating lines 507 aligned substantially in parallel; e.g., the floating lines are lines that are not connected to the ground or otherwise connected to any other circuit element that determines the state of the lines. The plurality of vertical floating lines 507 are disposed at the outer edge of the peripheral section 401, and perpendicular to the middle section 402 (see FIG. 4, not shown in FIG. 6). The symmetric half 503 further includes a plurality of interrupted vertical floating lines 505, e.g., lines that are similar to the vertical floating lines 507 but are interrupted segments, which includes one or more vertical lines 506 adjacent to the vertical floating lines 507. The one or more vertical lines 506 collect RF current electrical component disposed on the other side of the shielding structure. As the interrupted vertical lines 505 are discontinuous, the complete structure of the peripheral section 401 yields a floating structure without any magnetic loop.

FIG. 7 is a block diagram illustrating an example size of the peripheral section 401 as described in FIG. 4, according to some embodiments described herein. In the embodiment shown in FIG. 7, the width of the shielding includes an overlap of around 20-30 μm to provide complete shielding of the inductor coil 304, and also allow covering an entirety of the inductor coil 304 such that electrical components placed outside of the shield are not impacted by electromagnetic fields generated by the inductor coil 304.

The peripheral section 401 of the shielding structure is suitably made of any metal lines or polysilicon, or combination of several materials, in an embodiment.

FIG. 8 is a block diagram illustrating an example shielding structure for the middle section 402 of the shielding structure described in FIG. 4, according to some embodiments described herein. The middle section 402 suitably is a structure 800 composed of four quadruples 801*a-d* cross-connected by an X-shaped cross-connector 802. Each quadruple 801*a-d* of the structure 800 includes a plurality of parallel vertical lines forming a comb-like pattern, as shown at the structure 805. The structure 805 forms the middle section 402 of the shielding structure.

The middle section 402 is suitably made of any metal lines or polysilicon, or a combination of several materials. The middle section 402 is alternate current (AC) grounded or left floating, in an embodiment. In different implementations, different patterns, other than the four cross-connected quadruples, are used depending on the material being used.

In some implementations, electrical components such as the capacitor array 307*a-b* in FIG. 4 or other active components are disposed within the projection of the middle section 402 onto an adjacent layer of the integrated circuit device. For example, each "tooth" in the comb-like structure 805 suitably includes a capacitor.

FIG. 9 is a block diagram illustrating example circuitry employing an inductor similar to inductor 301 in FIG. 1, according to some embodiments described herein. In an embodiment, circuitry 900 is a digitally controlled oscillator (DCO), which typically is disposed at the core of a phase-locked loop (PLL). PLLs provide clock signals used in the process of up-conversion or down-conversion in a transmitter or receiver, respectively.

The figure-eight-shaped inductor coil has a first loop 902*a* and a second loop 902*b*, with input and output nodes 904*a-b* at the intersection portion and extensions 905*a-b*, respectively. Various electrical components, such as filters 912-913, cross-coupled device(s) 915, a current digital-to-analog converter 914, etc., are disposed within the empty area of the second loop 902*b*. The cross-coupled devices 915 include, for example, active circuitry (e.g., amplifier) of the DCO. Other electrical components provide biasing, filtering and bypassing. The electromagnetic field of inductor coils 902*a* and 902*b* is shielded by the shield 906.

In the DCO circuitry 900, a capacitor bank (e.g., capacitors of the same rating that are connected in parallel), denoted as "cap-bank" in FIG. 12, is divided into three parts including the fine cap-bank 901, cap-bank 1 at the intersection portion of the inductor, and cap-bank 2 (at 911) disposed within the empty area within the first loop 902*a*. Cap-bank 1 is suitably configured, in an embodiment, to provide coarse tuning, while cap-bank 2 (at 911) and the fine cap-bank 901 are respectively configured to provide progressively finer tuning. Cap-bank 1 (e.g., similar to capacitors 307*a-b* in FIG. 4) disposed directly at the intersection portion, in an adjacent layer on the other side of the shield from the layer where the inductor is disposed, in an embodiment.

Figure 10:
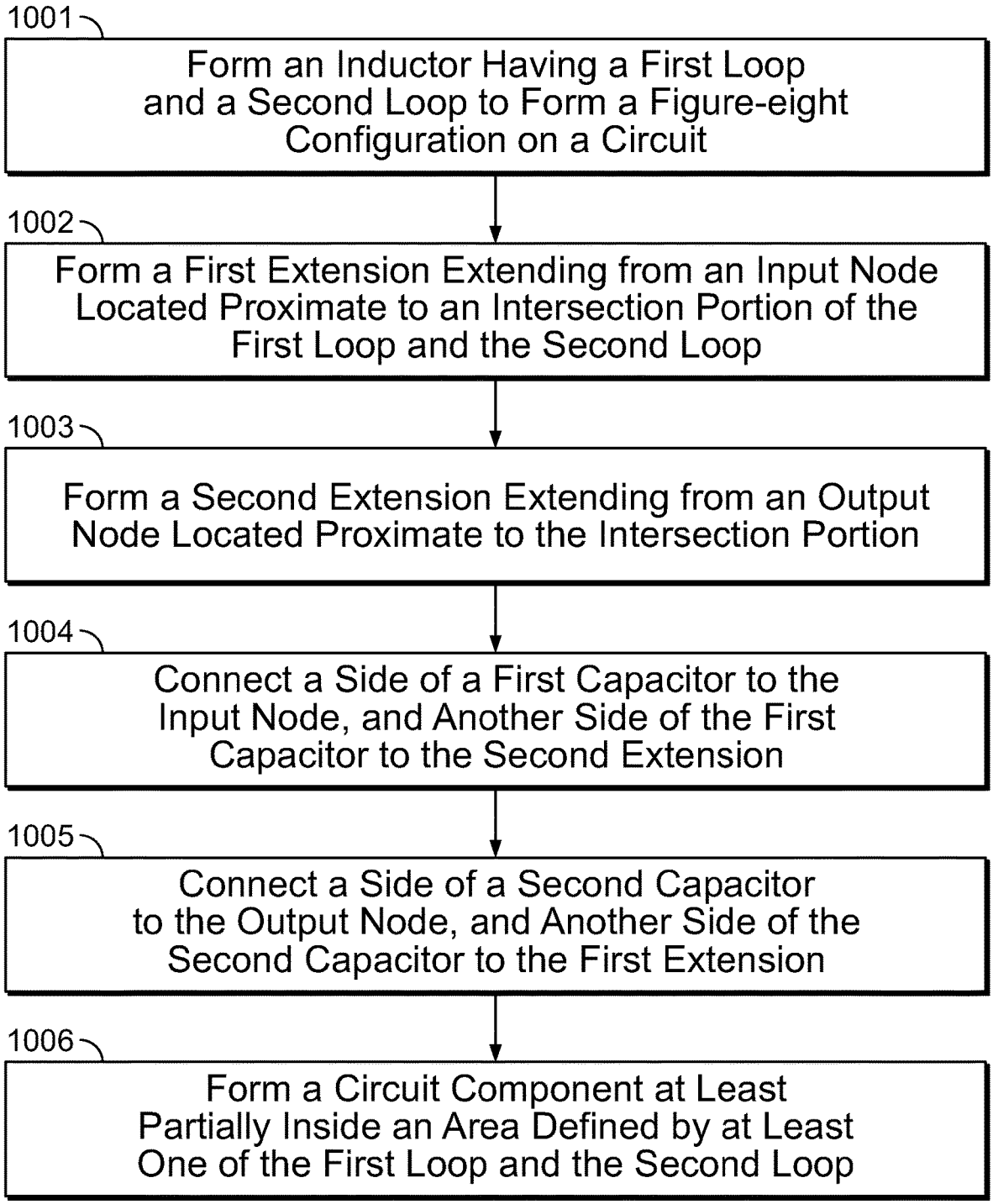
FIG. 10 is an example logic flow diagram illustrating aspects of forming and configuring an inductor structure as described in FIGS. 1-9, according to some embodiments described herein.

FIG. 10 is an example logic flow diagram illustrating aspects of configuring an inductor circuit employing the inductor structures described in FIGS. 1-9, according to some embodiments described herein. At 1001, an inductor (e.g., see 304, 314 and 324 in FIG. 4) is formed on a circuit to have a first loop and a second loop adjoining the first loop to form a figure-eight configuration. The first loop and the second loop are formed to have an intersection portion (e.g., see 309 in FIG. 4, etc.). At 1002, a first extension (e.g., see 306*a* in FIG. 4, etc.) is formed or configured to extend from an input node located proximate to the intersection portion. The first extension is disposed inside the first loop. At 1003, a second extension is formed or configured to extend from an output node located proximate to the intersection portion. The second extension is disposed inside the second loop. At 1004, a side of the at least one first capacitor is connected to the input node, and another side of the at least one first capacitor is connected to the second extension. At 1005, a side of at least one second capacitor is connected to the output node, and another side of the at least one second capacitor is connected to the first extension. At 1005, a circuit component (e.g., a filter, a DAC, an oscillator, etc.) is formed at least partially inside an area defined by at least one of the first loop and the second loop.

While various embodiments of the present disclosure have been shown and described herein, such embodiments are provided by way of example only. Numerous variations, changes, and substitutions relating to embodiments described herein are applicable without departing from the disclosure. It is noted that various alternatives to the embodiments of the disclosure described herein may be employed in practicing the disclosure. It is intended that the following claims define the scope of the disclosure and that methods and structures within the scope of these claims and their equivalents be covered thereby.

While operations are depicted in the drawings in a particular order, this is not to be construed as requiring that such operations be performed in the particular order shown or in sequential order, or that all illustrated operations be performed, to achieve the desirable results.

The subject matter of this specification has been described in terms of particular aspects, but other aspects can be implemented and are within the scope of the following claims. For example, the actions recited in the claims can be performed in a different order and still achieve desirable results. As one example, the process depicted in FIG. 10 does not necessarily require the particular order shown, or sequential order, to achieve desirable results. In certain implementations, multitasking and parallel processing may be advantageous. Other variations are within the scope of the following claims.

What is claimed is:

1. Circuitry employing an inductor having enhanced circuit area usage, comprising:

an inductor having:

a first loop;

a second loop adjoining the first loop to form a figure-eight configuration;

an intersection portion between the first loop and the second loop;

an input node located proximate to the intersection portion, the input node having a first extension disposed inside the first loop; and an output node located proximate to the intersection portion, the output node having a second extension disposed inside the second loop;

at least one first capacitor coupled to the input node and the second extension disposed inside the second loop;

at least one second capacitor coupled to the output node and the first extension disposed inside the first loop; and a circuit component disposed at least partially inside an area defined by at least one of the first loop and the second loop.

2. The circuitry of claim 1, wherein the first extension extends within a first planar surface defined by the first loop and from the input node, and the second extension extends within a second surface defined by the second loop and from the output node; and wherein the at least one first capacitor includes a plurality of capacitors, each coupled to the input node and the second extension in parallel to form a capacitor array, and the capacitor array operates to electromagnetically shield at least a part of the intersection portion.

3. The circuitry of claim 2, wherein the first loop or the second loop has one or more turns of electromagnetic coils, and wherein one or both of the at least one first capacitor and the at least one second capacitor span across multiple electromagnetic coils at the intersection portion.

4. The circuitry of claim 1, wherein the first extension extends perpendicularly to a first planar surface defined by the first loop and from the input node, and the second extension extends perpendicularly to the first planar surface defined by the first loop and from the output node; and wherein a part of the intersection portion forms a bridge that spans over the at least one first capacitor or the at least one second capacitor.

5. The circuitry of claim 1, further comprising:

an inductor shield formed in a figure-eight layout corresponding to the first and second loops and configured to cover the inductor, the area within the first loop or the second loop being uncovered.

6. The circuitry of claim 5, wherein the inductor shield includes:

a middle section covering the intersection portion, the middle section allowing a placement of the circuit component below the intersection portion when the circuit component is configured to connect to the input node or the output node; and a peripheral section covering turns of the first loop or the second loop, the peripheral section allowing routing signals to or from circuit elements placed below the inductor.

7. The circuitry of claim 6, wherein the middle section is composed of the at least one first capacitor and the at least one second capacitor.

8. The circuitry of claim 6, wherein the middle section has a structural pattern that is composed of a plurality of cross-connected quadruple squares.

9. The circuitry of claim 6, wherein the peripheral section is composed of a symmetrical structure including:

a first part having a plurality of floating lines connecting to the middle section; and a second part having a plurality of interrupted floating lines configured to allow current collection by one or more lines.

10. The circuitry of claim 1, wherein the circuit component is any of an integrated radio frequency oscillator, an amplifier, a filter or a phase-locked loop.

11. An inductor with enhanced circuit area usage, comprising:

a first loop;

a second loop adjoining the first loop to form a figure-eight configuration, wherein a circuit component is disposed at least partially inside an area defined by at least one of the first loop and the second loop;

an intersection portion between the first loop and the second loop;

an input node located proximate to the intersection portion, the input node having a first extension disposed inside the first loop;

an output node located proximate to the intersection portion, the output node having a second extension disposed inside the second loop;

at least one first capacitor coupled to the input node and the second extension disposed inside the second loop; and at least one second capacitor coupled to the output node and the first extension disposed inside the first loop.

* * * * *